US007743824B2

(12) United States Patent
Lam et al.

(10) Patent No.: US 7,743,824 B2
(45) Date of Patent: Jun. 29, 2010

(54) METHOD AND APPARATUS FOR ISOLATING A WELLHEAD FOR FRACTURING

(75) Inventors: Tony M. Lam, Edmonton (CA); Kevin Paul Schneider, Nisku (CA)

(73) Assignee: Stream-Flo Industries Ltd., Edmonton (CA)

( * ) Notice: Subject to any disclaimer, the term of this patent is extended or adjusted under 35 U.S.C. 154(b) by 96 days.

(21) Appl. No.: 12/052,532

(22) Filed: Mar. 20, 2008

(65) Prior Publication Data

US 2008/0230226 A1 Sep. 25, 2008

Related U.S. Application Data

(60) Provisional application No. 60/896,697, filed on Mar. 23, 2007.

(51) Int. Cl.
*E21B 33/068* (2006.01)

(52) U.S. Cl. ..... 166/177.5; 166/75.15

(58) Field of Classification Search ..... 166/382, 166/90.1, 75.14, 177.5
See application file for complete search history.

(56) References Cited

U.S. PATENT DOCUMENTS

| | | | |
|---|---|---|---|
| 2,233,077 | A | 2/1941 | Gillespie |
| 2,617,485 | A | 11/1952 | Thatch |
| 3,255,823 | A | 6/1966 | Barton |
| 4,993,488 | A | 2/1991 | McLeod |
| 5,819,851 | A | 10/1998 | Dallas |
| 6,247,537 | B1 | 6/2001 | Dallas |
| 6,364,024 | B1 | 4/2002 | Dallas |
| 6,491,098 | B1 | 12/2002 | Dallas |
| 6,516,861 | B2 | 2/2003 | Allen |
| 6,675,900 | B2 | 1/2004 | Baskett |
| 6,920,925 | B2 | 7/2005 | Duhn |
| 7,069,987 | B2 | 7/2006 | Kwasniewski |
| 7,308,934 | B2 | 12/2007 | Swagerty |

(Continued)

FOREIGN PATENT DOCUMENTS

| | | |
|---|---|---|
| CA | 2276973 | 7/1999 |

OTHER PUBLICATIONS

Back Pressure Valves/Tree Test Plugs, FM Technologies, pp. 8-9, Revised 8-97.

(Continued)

*Primary Examiner*—William P Neuder
(74) *Attorney, Agent, or Firm*—Greenlee Winner and Sullivan PC

(57) ABSTRACT

A wellhead assembly to seal to a production casing including one or more pressure-containing wellhead body members defining a vertical bore, with the lowermost of the wellhead body members sealing to the production casing. A fracturing isolation tool is sealed in the vertical bore of the wellhead body members above the production casing, and forms a pressure barrier profile in its internal bore. A removable protector sleeve is located at least partially within the fracturing isolation tool to seal, protect, isolate and cover the pressure barrier profile against a fracturing pressure and a fracturing fluid. After fracturing the protector sleeve is removed and a pressure barrier is sealed in the pressure barrier profile of the fracturing isolation tool. The invention also extends to the method of isolating the wellhead body members and to the fracturing isolation tool assembly which includes the fracturing isolation tool and the protector sleeve.

21 Claims, 15 Drawing Sheets

U.S. PATENT DOCUMENTS

| | | | | |
|---|---|---|---|---|
| 7,322,407 | B2 * | 1/2008 | Duhn et al. | 166/75.14 |
| 7,490,666 | B2 * | 2/2009 | Swagerty et al. | 166/177.5 |
| 2005/0092496 | A1 | 5/2005 | Duhn | |

OTHER PUBLICATIONS

Isolation Sleeve System, FMC Technologies brochure (undated).

* cited by examiner

METHOD AND APPARATUS FOR ISOLATING A WELLHEAD FOR FRACTURING

CROSS-REFERENCE TO RELATED APPLICATIONS

This application claims priority from U.S. Provisional Patent Application No. 60/896,697, filed Mar. 23, 2007, which is incorporated by reference herein in its entirety to the extent that there is no inconsistency with the present disclosure.

BACKGROUND OF THE INVENTION

This invention relates to a method and apparatus for isolating a portion of a wellhead during a fracturing operation.

One frequent well servicing technique for oil and gas formations having low permeability is to artificially "stimulate" to increase the permeability of the production zone(s). Generally, these stimulation techniques are referred to as "fracturing". Fracturing involves pumping pressurized fluids through perforations in a well casing into a production zone in order to break or fracture pores in the production zone to improve permeability so that the hydrocarbon fluids can drain from the production zone into the casing. Fracturing generally involves first using a tool known as a perforating gun to perforate the production zone adjacent the casing. Thereafter, fracturing fluids are pumped under very high pressures of about 5,000-10,000 psi through the perforations into the formation. The high pressure breaks the formation to form a flow channel for hydrocarbon fluids. Proppants are also injected to prevent the formation from collapsing after the high stimulation pressure is released.

During fracturing, isolation tools are needed to isolate the wellhead from the high pressures of fracturing, since fracturing pressures are typically much higher than the wellhead pressure rating (which might be rated only at 5,000 psi, for example). In the prior art, these fracturing isolation tools generally seal inside the casing or on the bit guide in a manner which can restrict full bore access to the casing. Full bore access is particularly desirable for fracturing techniques which involve fracturing in stages. After fracturing, the fracturing isolation tool is removed. At this point, since the well may be live, it is necessary to maintain control over the well. One prior art approach is to install a bridge plug, which seals inside the casing. These tools are expensive to rent and to use. Another approach is to control the well pressure with a column of mud or water. However, this procedure can damage the formation. Both of the above approaches require a service crew at the well, which is time and resource intensive.

Fracturing isolation sleeves are shown in a number of patents, see for example U.S. Pat. Nos. 5,819,851; 6,247,537; 6,364,024; and 6,491,098 to Dallas, Canadian Patent 2,276,973 to Dallas, U.S. Pat. No. 4,993,488 to McLeod, U.S. Pat. No. 6,516,861 to Allen, and U.S. Pat. No. 6,920,925 to Duhn et al.

U.S. Pat. No. 7,069,987, filed Feb. 6, 2004, issued Jul. 4, 2006 to Kwasniewski et al., (assigned to the assignee of the present application), discloses a casing adapter tool to accommodate fracturing equipment at the wellhead during fracturing, and then to accommodate one or more pressure barrier seals in the wellhead, such as a check valve, after the fracturing operation. Full bore access to the production casing is preferably provided by this tool.

U.S. Pat. No. 7,308,934, filed Feb. 18, 2005, issued Dec. 18, 2007 to Swagerty et al., discloses a fracturing isolation sleeve for use in two wellhead members above a production casing. The fracturing isolation sleeve seals in the wellhead members above the production casing. As well, the sleeve bridges the two wellhead body members, i.e., is disposed in the internal bores of both of the wellhead body members. The wellhead members are typically a tubing head and an adapter. Further, the fracturing isolation sleeve has an internal diameter greater than or equal to the internal diameter of the production casing. The fracturing isolation sleeve is formed with a pressure barrier profile to seal a pressure barrier in its central bore.

The isolation sleeve of the Swagerty patent is directed at solving previous prior art problems which arise when the wellhead isolation tool seals to the inside surface of the casing string. In that previous prior art, the inside diameter of the wellhead isolation tool is substantially smaller than the inside diameter of the casing string. The bridge plugs, which are designed to have an outside diameter the same as the drift of the casing string, cannot pass through the wellhead isolation tool. Therefore, each time a bridge plug is installed, the wellhead isolation tool is removed and the wireline lubricator installed. Repetitive installation and removal of equipment adds to the costs of managing the wellhead.

However, a problem exists with the fracturing isolation sleeve of the Swagerty patent. During the fracturing operation within the fracturing isolation sleeve, the seal surfaces and the pressure barrier profiles formed for the later to be installed pressure barriers are both exposed to the fracturing environment, i.e., the high pressure and abrasion of the fracturing fluids. This exposure may damage the sealing surfaces and/or pressure barrier profile, preventing the pressure barrier from sealing after the fracturing process.

SUMMARY OF THE INVENTION

The invention broadly provides a fracturing isolation assembly for use in one or more wellhead body members located above a production casing in a manner to isolate any seals and openings in the wellhead members against fracturing pressures and fluids, but also in a manner to protect the interlocking surfaces and/or sealing surfaces of a pressure barrier profile formed within the fracture isolation assembly, to seal, isolate, cover and protect these surfaces against the fracturing pressures and fluids so that these surfaces connect and seal to a later to be installed pressure barrier. The wellhead assembly of the invention seals to a production casing and further includes:

one or more pressure-containing wellhead body members defining a vertical bore extending there through, the lowermost end of the one or more wellhead body members being adapted to seal to the production casing;

a fracturing isolation tool sealed in the vertical bore of the one or more wellhead body members above the production casing, and forming an internal bore extending vertically there through;

a pressure barrier profile formed in the internal bore of the fracturing isolation tool to accommodate a pressure barrier;

a removable protector sleeve located at least partially within the fracturing isolation tool to seal, protect, isolate and cover the pressure barrier profile against a fracturing pressure and a fracturing fluid, the protector sleeve forming an internal bore extending vertically there through; and optionally, a pressure barrier for sealing in the pressure barrier profile of the fracturing isolation tool when the protector sleeve is removed.

Preferably, the one or more wellhead members includes a tubing head and a tubing head adapter connected above the tubing head, the fracturing isolation tool seals in the vertical bore of the tubing head, the protector sleeve seals in the vertical bore of the adapter, and the pressure barrier profile is formed in the fracturing isolation tool at a location within the tubing head. In this way, when the fracturing isolation tool and the protector sleeve are sealed in the vertical bore, all seals and openings in the tubing head and the tubing head adapter are protected from the fracturing pressure and the fracturing fluid.

The invention also broadly extends to a fracture isolation assembly including the fracturing isolation tool and the protector sleeve, and optionally a pressure barrier. The invention also broadly extends to a method of isolating one or more wellhead members for fracturing using the fracturing isolation assembly.

BRIEF DESCRIPTION OF THE DRAWINGS

FIGS. 1-3 are side sectional views of a first embodiment of the method and apparatus of the present invention, in which:

FIG. 1 shows a tubing head and a tubing head adapter, the tubing head sealing at its lower end to the production casing, a fracturing isolation tool sealed in the vertical bore of the tubing head, and a pressure barrier profile formed at the upper end of the fracturing isolation tool;

FIG. 2 shows a removable protector sleeve sealed at its upper end in the vertical bore of the adapter and sealed at its lower end in the pressure barrier profile of the fracturing isolation tool in order to seal, protect, isolate and cover the pressure barrier profile during fracturing; and FIG. 3 shows the protector sleeve removed after fracturing, with the pressure barrier (back pressure valve) sealed in the pressure barrier profile of the fracturing isolation tool.

DETAILED DESCRIPTION OF THE INVENTION

The present invention is aimed at solving one or more of the problems of prior art fracturing isolation tools by protecting the profile for the pressure barrier from the fracturing environment.

As used herein, "comprising" is synonymous with "including," "containing," or "characterized by," and is inclusive or open-ended and does not exclude additional, unrecited elements or method steps. The invention illustratively described herein suitably may be practiced in the absence of any element or elements, limitation or limitations which is not specifically disclosed herein.

The use of the indefinite article "a" in the claims before an element means that one of the elements is specified, but does not specifically exclude others of the elements being present, unless the context clearly requires that there be one and only one of the elements.

As used herein and in the claims, a reference to "a connection", "connected", "connecting" or "connect(s)" is a reference to a sealed pressure-containing connection unless the context otherwise requires.

By the term "full bore access", as used herein and in the claims, is meant a diameter which is equal to or greater than the drift diameter of the casing pipe.

By the term "drift diameter", as used herein and in the claims, is meant the insider diameter (ID) that the pipe manufacturer guarantees as per specifications. Thus, the nominal ID of the casing is not the same as the drift diameter, but rather is slightly larger.

By the term "pressure barrier", as used herein and in the claims, is meant a check valve, back pressure valve or plug which protects equipment and devices located thereabove against downhole pressure.

By the term "vertical", as used herein and in the claims, such as with the term "vertical bore" is meant to include angled well bores which are not strictly vertical, but which may be inclined at an angle less than 900 to the vertical, as is well known in the oil field.

Figure 1:
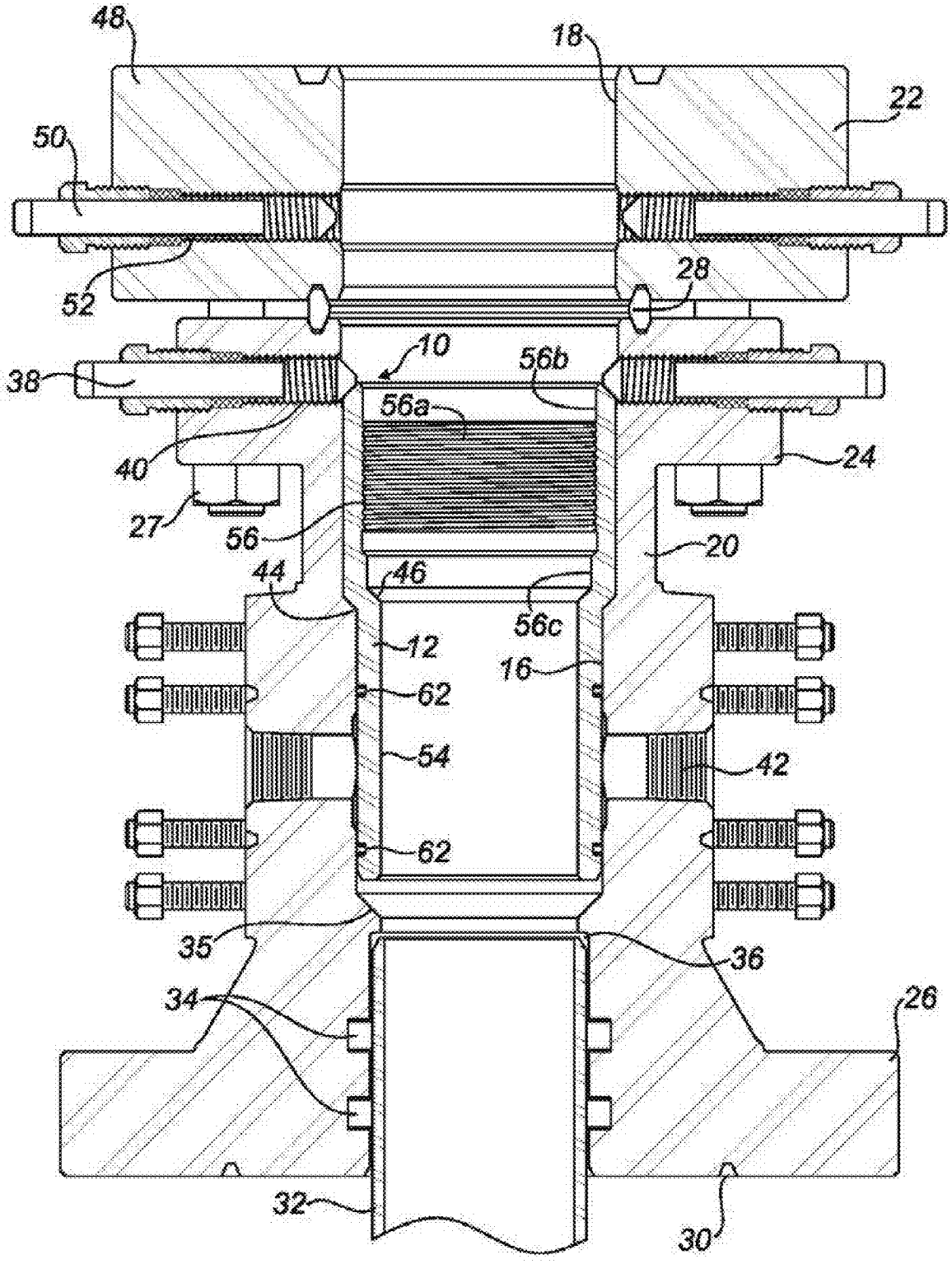
Figure 2:
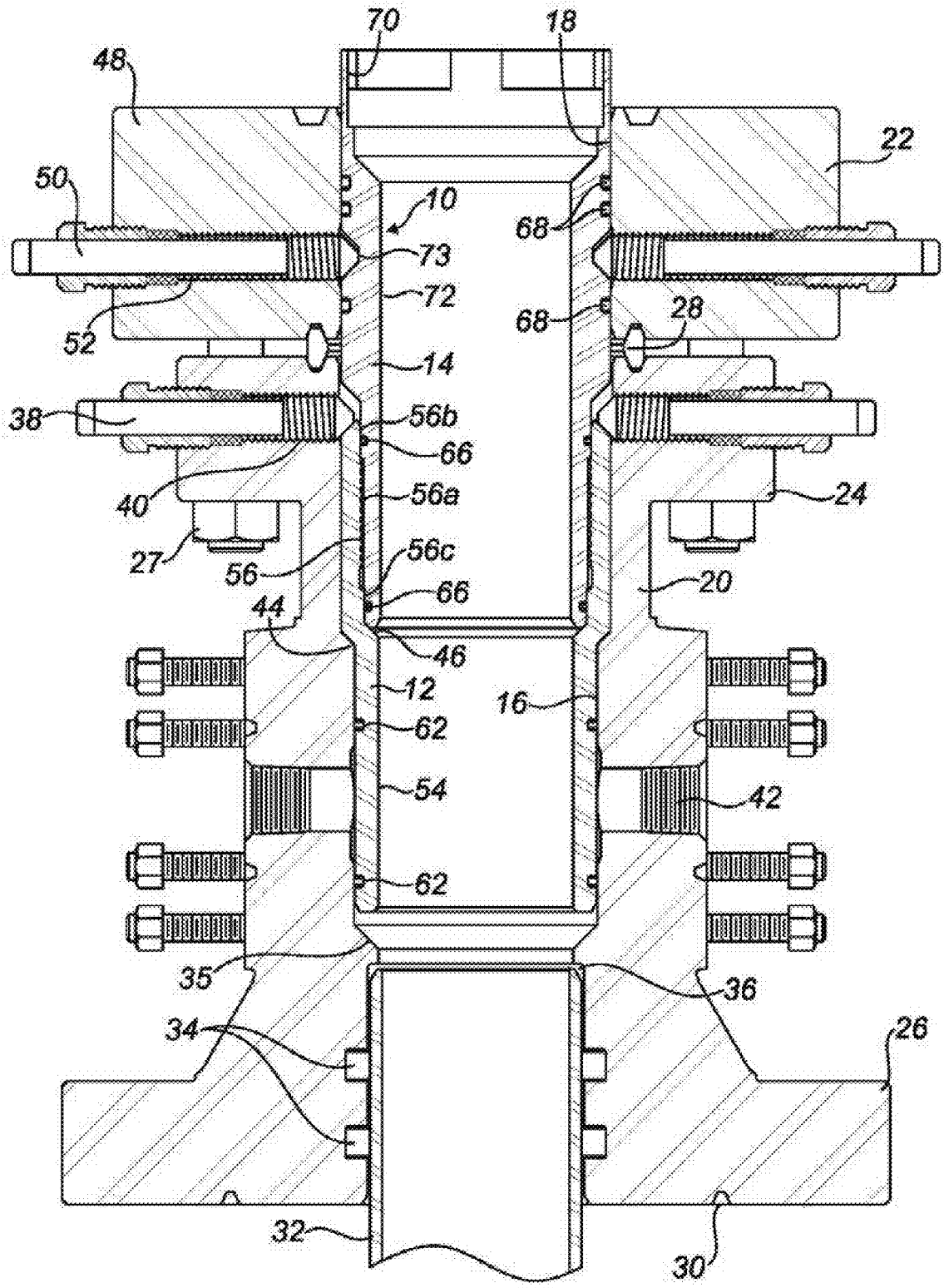
Figure 3:
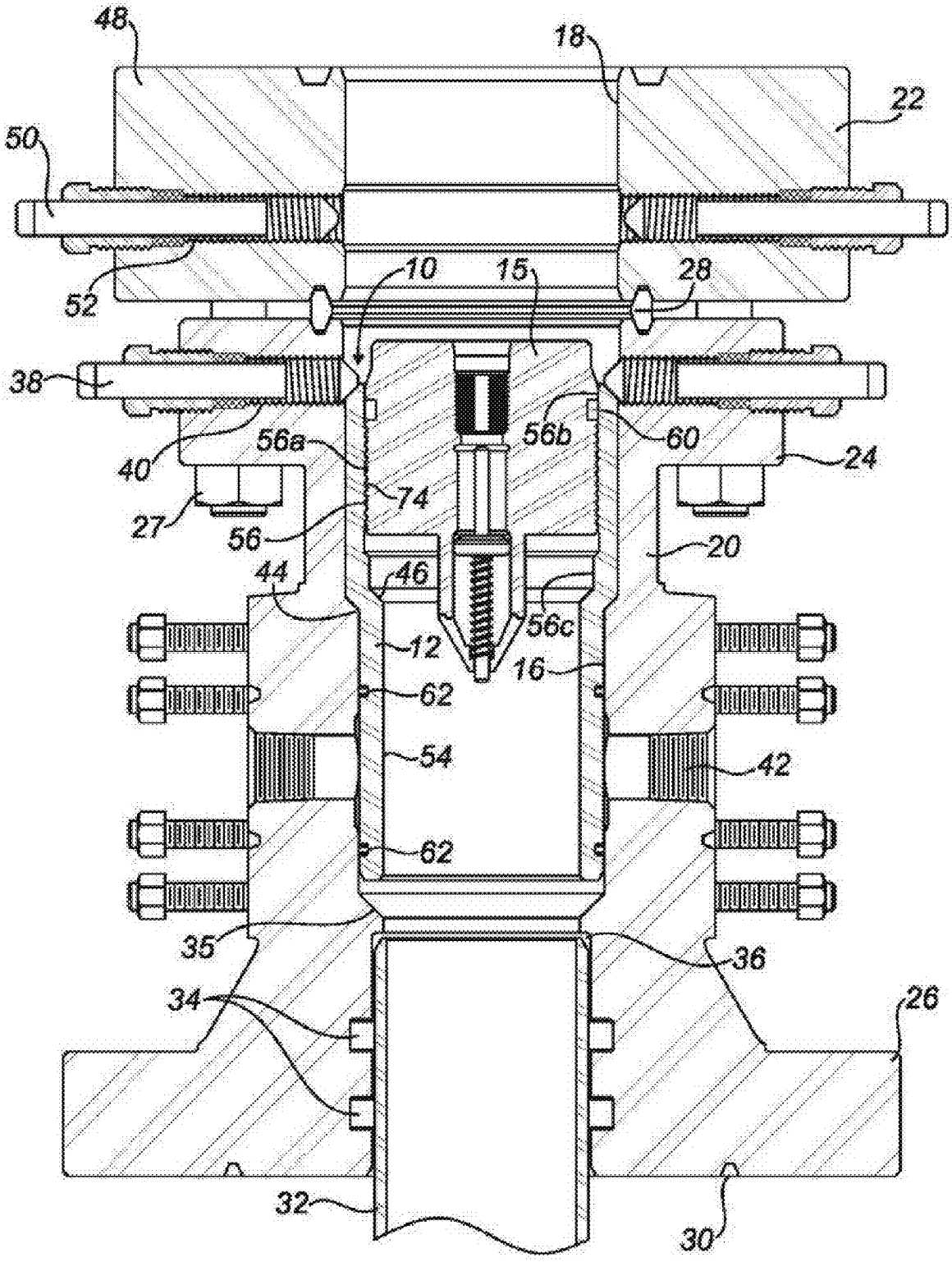

The fracturing isolation assembly 10 of this invention is shown in the figures as including a lower fracturing isolation tool 12 and an upper protector sleeve 14. The fracturing isolation tool 12 and protector sleeve 14 may be located within a wellhead composed of one or more wellhead body members, although in the embodiments shown herein the wellhead includes at least two connected wellhead body members. The fracturing isolation tool 12 and the protector sleeve 14 are shaped and sized so that, when engaged together in sealing relationship during fracturing within the wellhead, they combine to seal the vertical bore through the one or more wellhead body members in a manner such that all seals and openings in and between the wellhead members are protected from the fracturing pressure and the fracturing fluid. Turning to the figures, a first embodiment of the fracturing isolation assembly 10 is shown in FIGS. 1-3 to be located in the vertical bores 16, 18 of a lower tubing head 20 and a tubing head adapter 22. When sealed together, the fracturing isolation tool 12 and the protector sleeve 14 bridge the two wellhead body members 20, 22 such that, during fracturing, all openings, seals and connections formed within and between the two wellhead members 20, 22 are sealed. These wellhead openings, connections or seals are typically underrated for fracturing pressures.

The fracturing isolation tool 12 is designed to retain a pressure barrier 15 after the fracturing operation when the protector sleeve 14 is removed. At least the protector sleeve 14 is removable (i.e., retrievable from above with an appropriate retrieval tool) through the tubing head adapter 22, and preferably through one or more wellhead members such as valves located thereabove (not shown). The fracturing isolation tool 12 is preferably removable from the tubing head 20, and more preferably removable through the tubing head adapter 22 and at least one wellhead member located thereabove.

The tubing head 20 is shown to include top and bottom flanges 24, 26 formed with upper and lower circumferential face seals 28, 30 for connection through stud connectors 27 to wellhead members located above or below. The lower end of the tubing head 20 is adapted to receive and seal to the production casing pipe 32 for example through built-in circumferential secondary casing seals 34. The vertical bore 16 of the tubing head 20 preferably forms a built-in bit guide 35 above the casing pipe 32, and an inwardly extending stop shoulder 36 to protect the top of the casing pipe 32. The top flange 24 is perforated for a plurality of tubing head lockscrews 38 sealed in horizontal conduits 40 extending into the vertical bore 16. The tubing head 20 further includes studded side outlets 42 intermediate its top and bottom flanges 24, 26. The vertical bore 16 is formed with an inwardly extending landing shoulder 44 to mate with the outwardly extending landing shoulder 46 of the fracturing isolation tool 12.

The tubing head adapter 22 is formed for connection to the tubing head 20 through an adapter flange 48 perforated for a plurality of adapter lockscrews 50 sealed in horizontal conduits 52 extending into the vertical bore 18.

Figure 11:
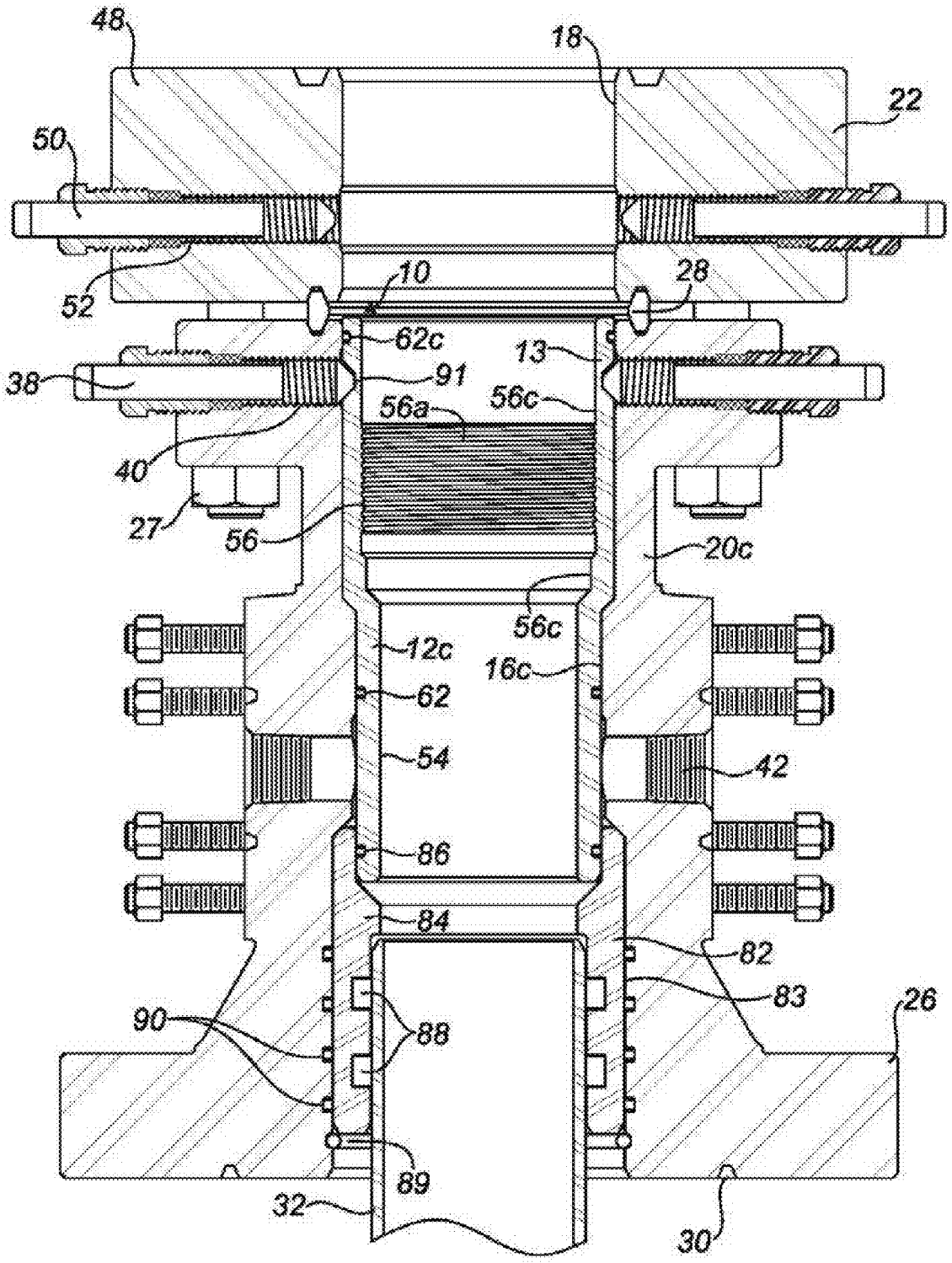
FIGS. 11 and 12 are side sectional views of a fifth embodiment of the method and apparatus of the present invention showing an interchangeable secondary seal bushing at the lower end, as in FIG. 10, but differing from FIG. 10 in that the fracturing isolation tool is elongated to seal in the vertical bore of the tubing head above the tubing head lockscrews, instead of below the tubing head lockscrews as in the first embodiment.
Figure 12:
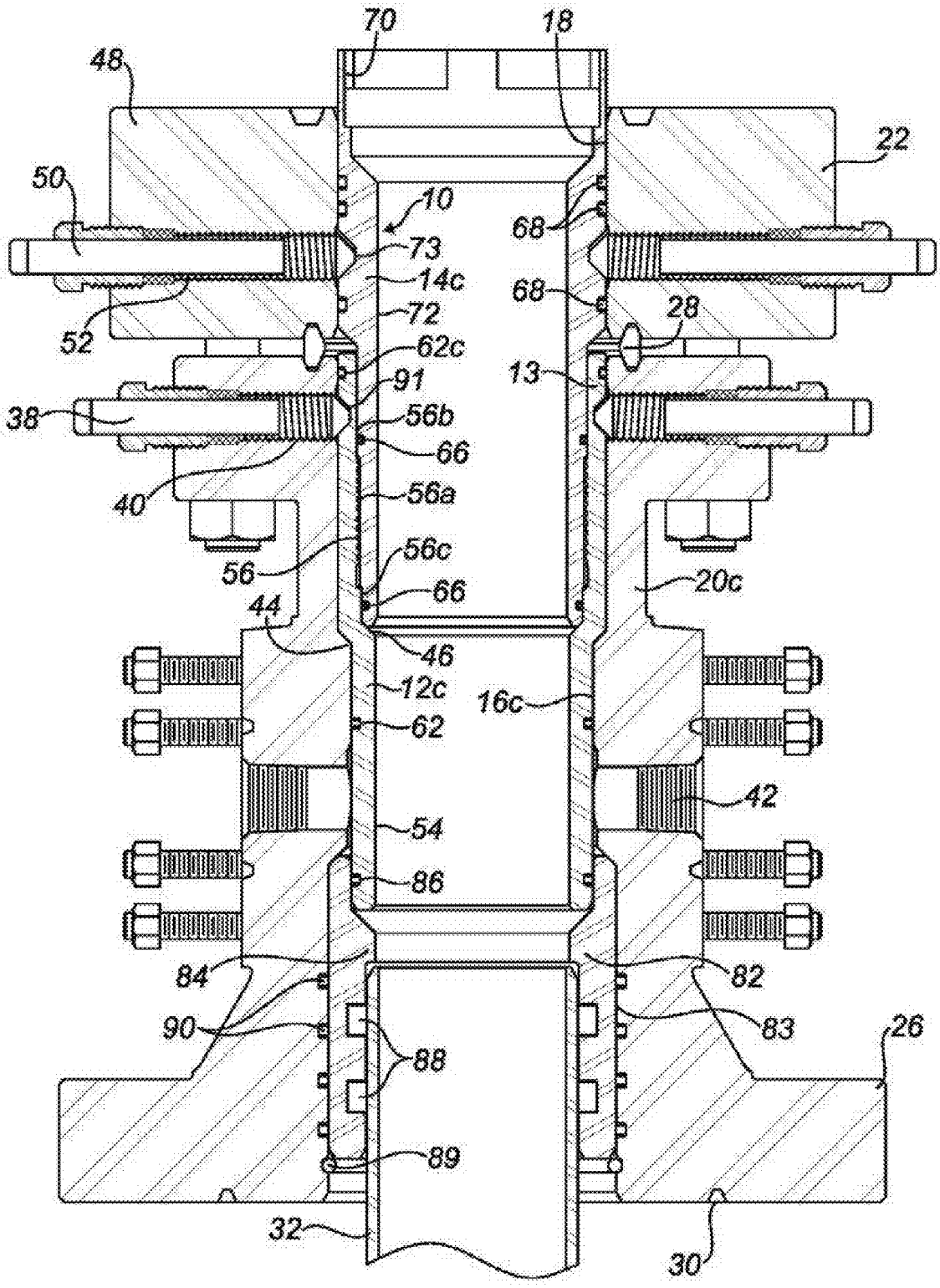

The generally tubular fracturing isolation tool 12 is formed with an internal bore 54 preferably sized to allow full bore access to the casing pipe 32. The internal bore 54 forms a pressure barrier profile 56. The pressure barrier profile 56 is a shape formed wholly within the bore 54 to seat and seal a later to be installed pressure barrier. The profile 56 is typically formed by machining into the bore 54 one or more landing shoulders and interlocking surfaces such as threads or grooves for the pressure barrier, and smooth sealing surfaces located above and/or below the interconnecting surfaces for the circumferential sealing of the protector sleeve 14 and/or pressure barrier 15, as described more fully below. In the figures, the pressure barrier profile 56 is formed in the upper portion above the landing shoulder 46 of the fracturing isolation tool 12, although it could be located lower. The profile 56 illustrated in FIG. 1 has a threaded section 56*a* which provides an interlocking surface to retain the pressure barrier 15. The threaded section 56*a* is located above an inwardly extending barrier landing shoulder 58. Upper and lower sealing surfaces 56*b*, 56*c* are located above and below the threaded section 56*a*. The upper sealing surface 56*c*, as seen in FIG. 3, provides a sealing surface for the circumferential seal 60 of the pressure barrier 15. Both the upper and lower sealing surfaces 56*b*, 56*c* provide for sealing to the protector sleeve 14 as described below. The fracturing isolation tool 12 carries circumferential seals 62 (fracture isolation seals) on its outer diameter to seal to the vertical bore 16 in order to seal all openings to the bore 16. In FIG. 1, the seals 62 are located above and below the side outlets 42. The fracturing isolation tool 12 is retained against upward pressure by the tubing head lockscrews 38, or other known retaining mechanisms. In FIGS. 1-3, the upper end of the fracturing isolation tool 12 ends just below the lockscrews 38. However, the fracturing isolation tool 12 could extend further upwardly, even to seal the bore 18 of the tubing head adapter 22. In FIGS. 11 and 12, the fracturing isolation tool 12*c* is extended upwardly to end above the lockscrews 38, in which case, to seal the vertical bore 16, an additional circumferential seal 62*c* is provided on the fracturing isolation tool 12*c* above the lockscrews 38.

The generally tubular protector sleeve 14 (see FIG. 2) has an outside diameter for close fitting relationship within the pressure barrier profile 56 of the fracturing isolation tool 12. Outer circumferential seals 66 are carried by the protector sleeve 14 located to seal to the upper and lower sealing surfaces 56*b*, 56*c* of the pressure barrier profile 56. In this way, the protector sleeve 14, when engaged in sealing relationship within the pressure barrier profile 56 of the fracture isolation tool 12, seals, protects, covers and isolates the pressure barrier profile 56 from the fracturing pressure and fluids of fracturing. While the protector sleeve 14 may carry mating threads at its lower end to connect to the threaded portion 56*a* of the pressure barrier profile 56, this is not necessary. The figures show the protector sleeve 14 formed without threads. The protector sleeve 14 carries outer circumferential seals 68 (fracture isolation seals) to the vertical bore 18 of the tubing head adapter 22. In FIG. 2, these seals 68 are located above and below the tubing head adapter lockscrews 50. The protector sleeve 14 is preferably formed with a pressure barrier profile 70 in its internal bore 72, as seen in FIG. 2. This profile 70 might be threaded with landing shoulder and sealing surfaces, as described above for the pressure barrier profile 56 of the fracturing isolation tool 12, or might be altered depending on the particular pressure barrier to be sealed therein (for example, see the pressure barrier shown in FIG. 15). The protector sleeve 14 is also formed with a groove or dimples 73 on its outer circumference to receive the lockscrews 50 in order to retain the protector sleeve 14 in the bore 18 of tubing head adapter 22.

FIG. 3 shows the protector sleeve 14 removed after fracturing, with the pressure barrier 15 sealed in the pressure barrier profile 56 of the fracturing isolation tool 12. In FIG. 3, the pressure barrier 15 is a back pressure valve (BPV) having threads 74 which mate with the threaded section 56*a* of the fracturing isolation tool 12. However, other types of pressure barriers may be used (see for example FIG. 15), in which case the pressure barrier profile 56 is modified to provide for landing, retention and sealing for that particular pressure barrier.

Although the one or more wellhead body members are shown with flange connections top and bottom, other connections are possible, as known in the art. The bottom connector to the production casing 32 may include a slip lock connector, a welded connection, a threaded connection or a flange connection. The lowermost wellhead member, shown here as the tubing head 20, may include an inwardly extending stop shoulder to protect the top of the production casing. The top connectors of the uppermost wellhead member may include a threaded, flange or clamp connection, as appropriate to connect to the production or service equipment (not shown).

Figure 4:
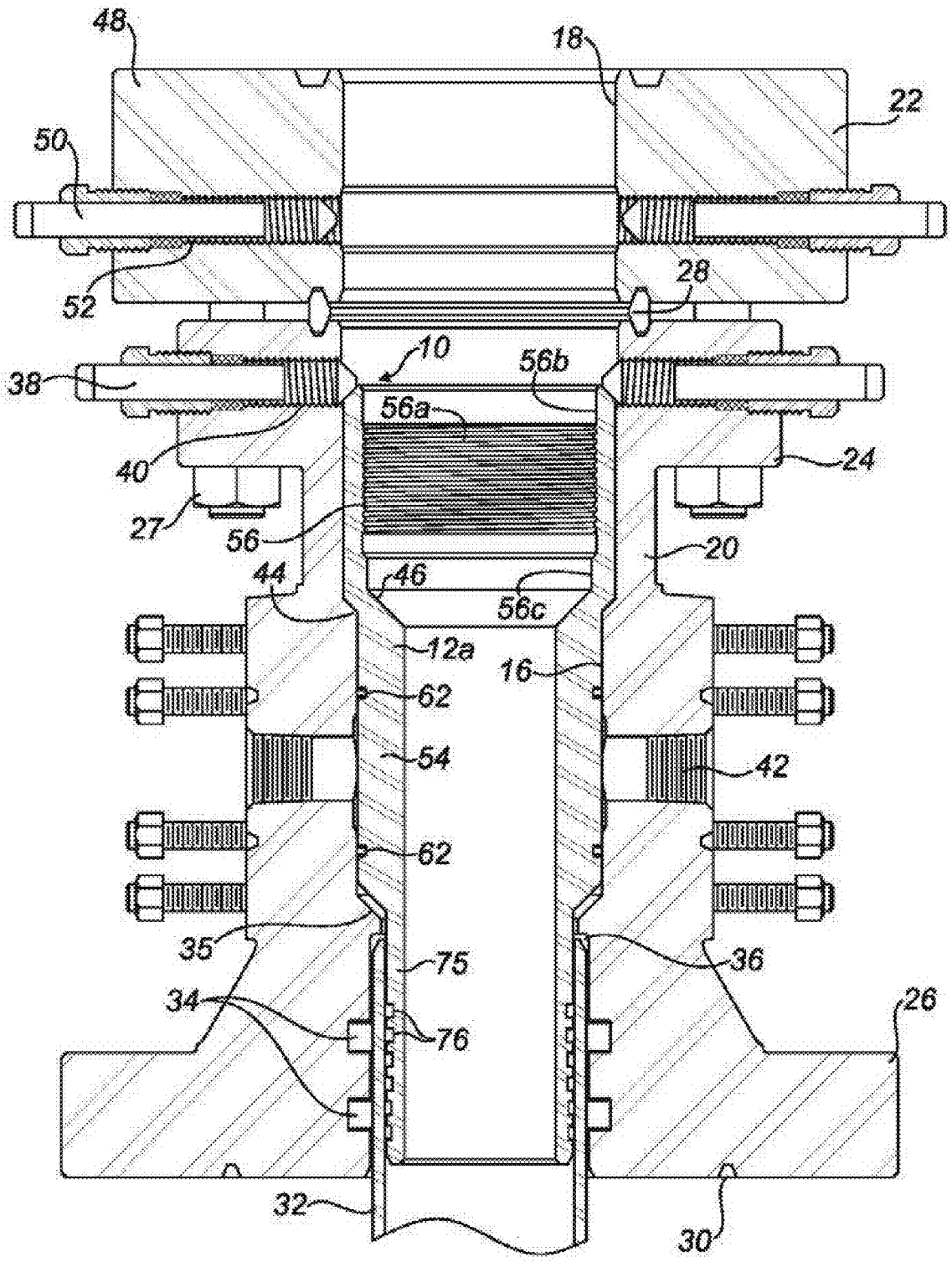
FIGS. 4-6 are side sectional views of a second embodiment of the method and apparatus of the present invention, which varies from the first embodiment in that the fracturing isolation tool seals at its lower end inside the production casing.
Figure 5:
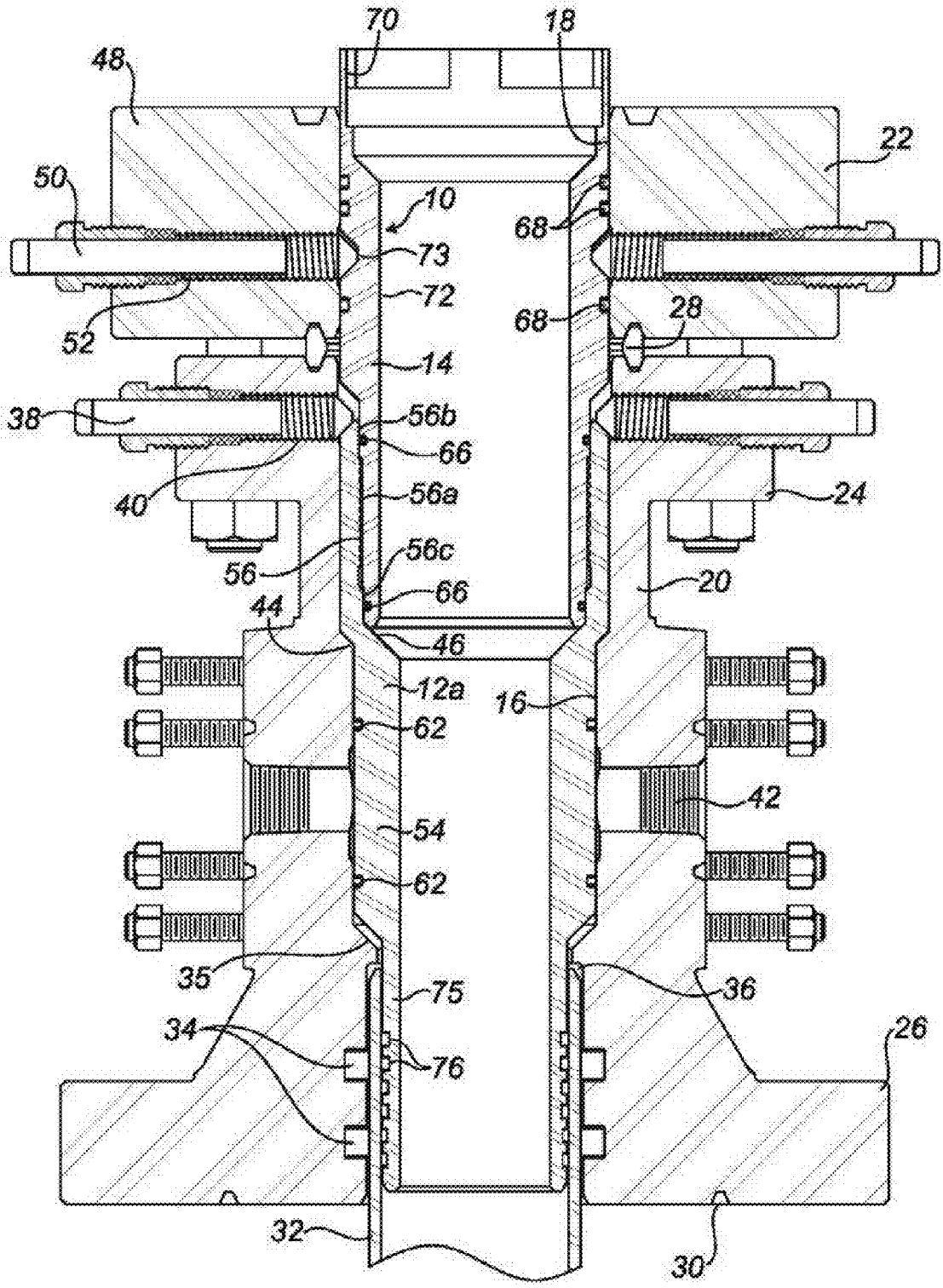
Figure 6:
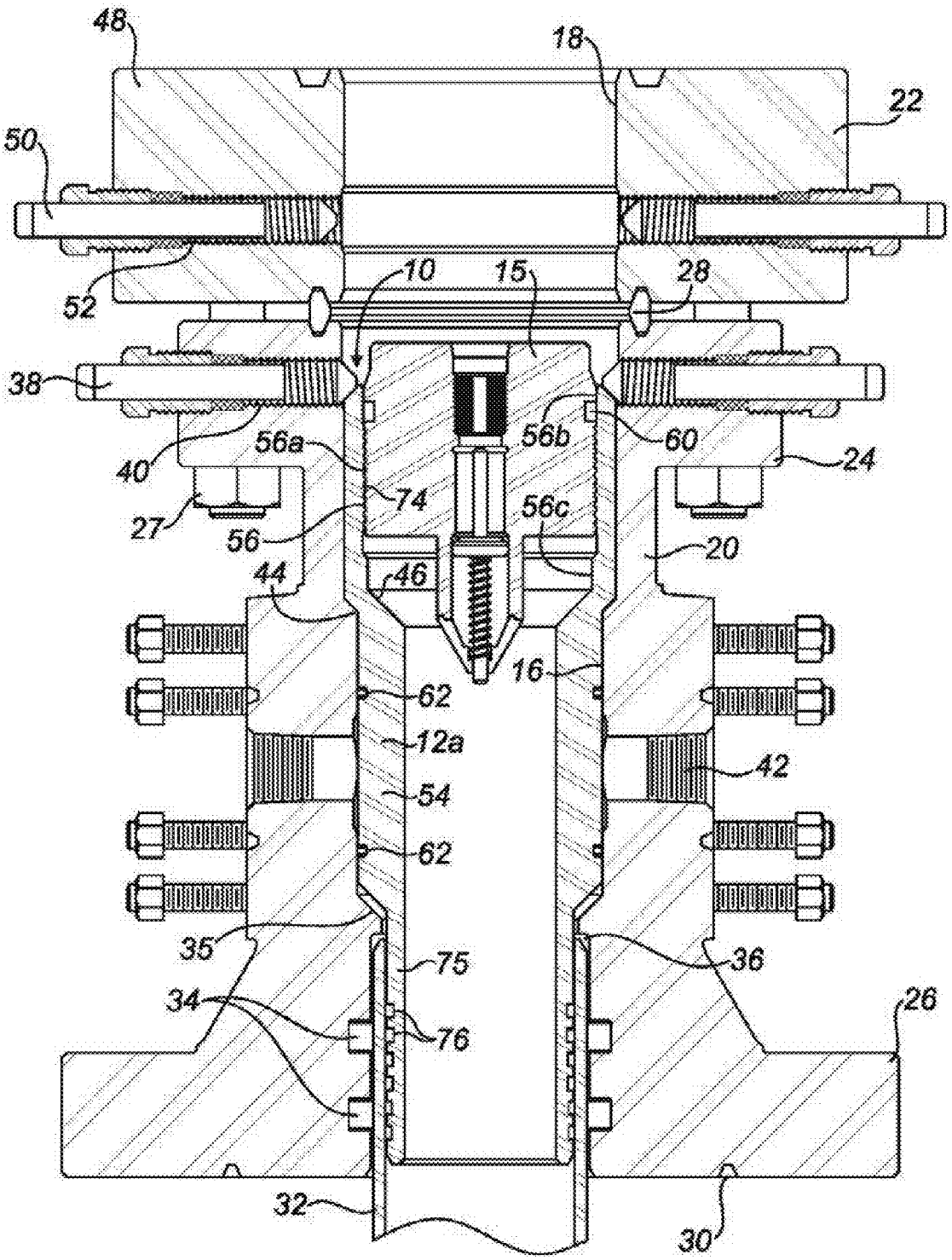

FIGS. 4-6 show a second embodiment of the method and apparatus of the present invention, which varies from the first embodiment in that the fracturing isolation tool 12*a* extends downwardly with a lower extension 75 to seal at its lower end inside the production casing 32 through a plurality of outer circumferential seals 76. In this embodiment, less than full bore access is provided to the casing 32. Apart from this difference, like features to the first embodiment are commonly labeled in FIGS. 4, 5 and 6.

Figure 7:
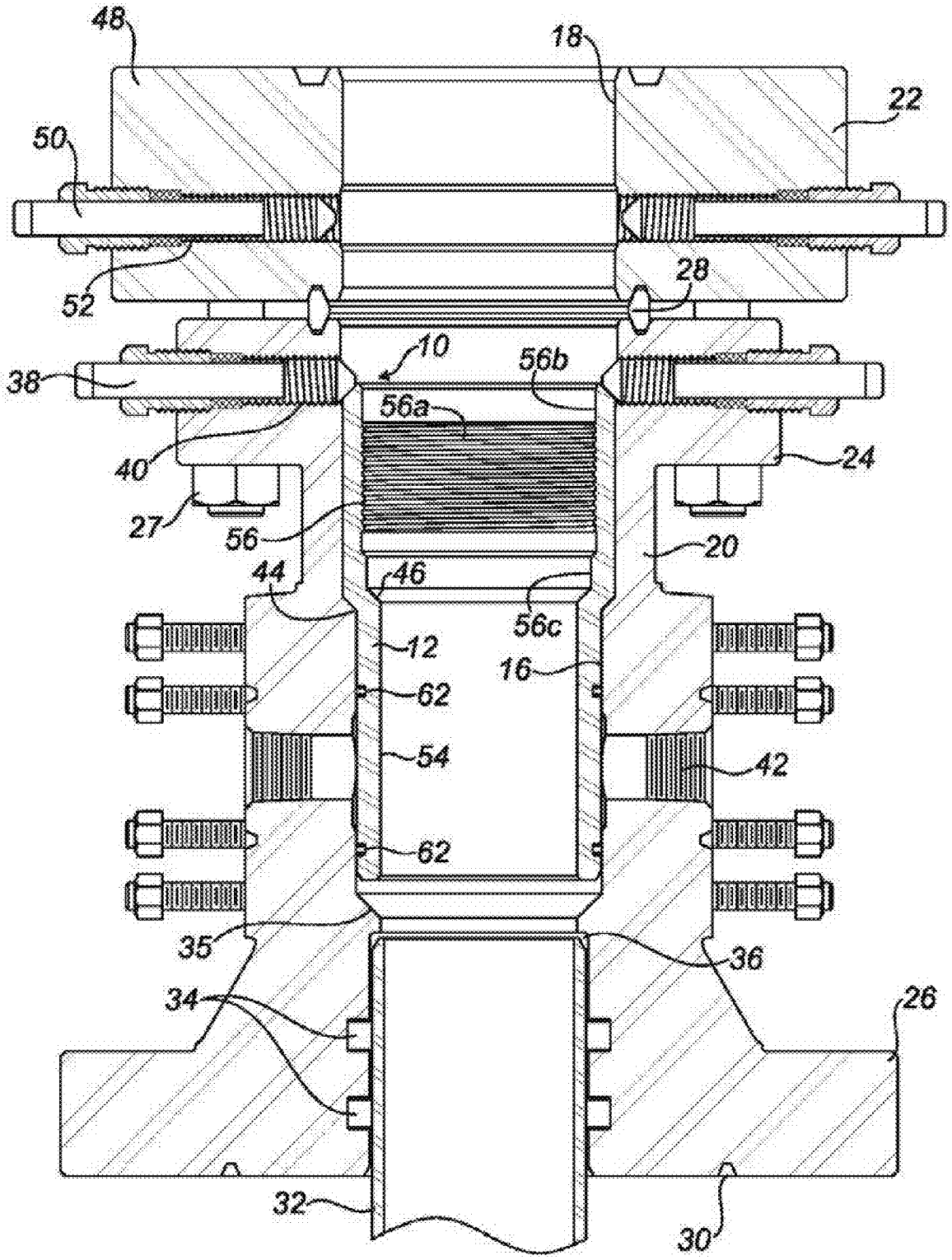
FIGS. 7-9 are side sectional views of a third embodiment of the method and apparatus of the present invention, which varies from the first embodiment in that the protector sleeve is elongated to seal at its upper end in the adapter, in its mid portion in the pressure barrier profile of the fracturing isolation tool, and at its lower end inside the production casing.
Figure 8:
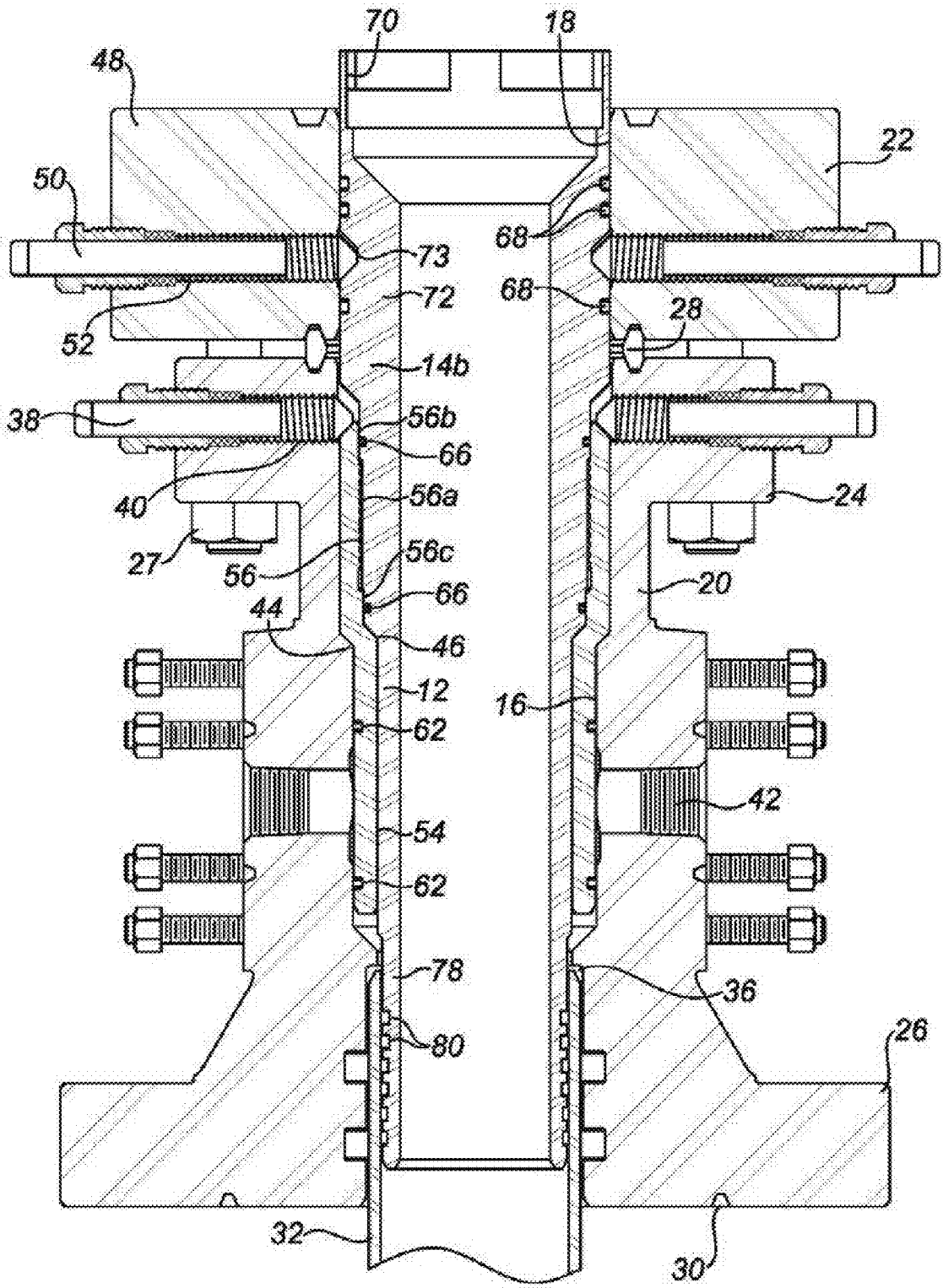
Figure 9:
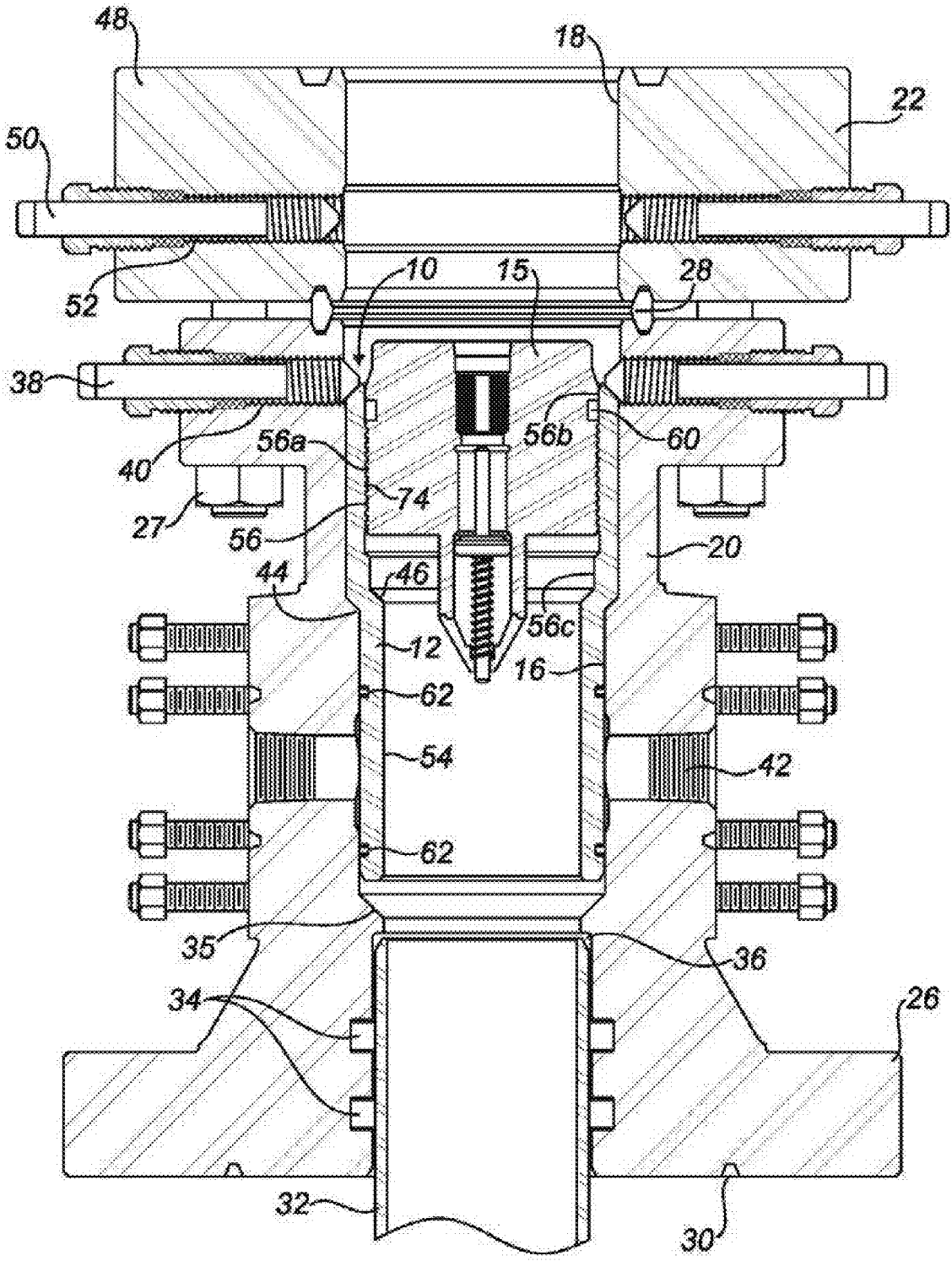

FIGS. 7-9 show a third embodiment of the method and apparatus of the present invention, which varies from the first embodiment in that the protector sleeve 14*b* is elongated. The upper end of the sleeve 14*b* still seals the tubing head adapter 22 as described for the first embodiment. The mid portion of the protector sleeve 14*b* seals in the pressure barrier profile 56, as described for the first embodiment. However, the lower extension 78 of the protector sleeve 14*b* extends through the fracture isolation tool 12 to seal at its lower end inside the production casing 32 by outer circumferential seals 80. Apart from this difference, like features to the first embodiment are commonly labeled in FIGS. 7, 8 and 9.

Figure 10:
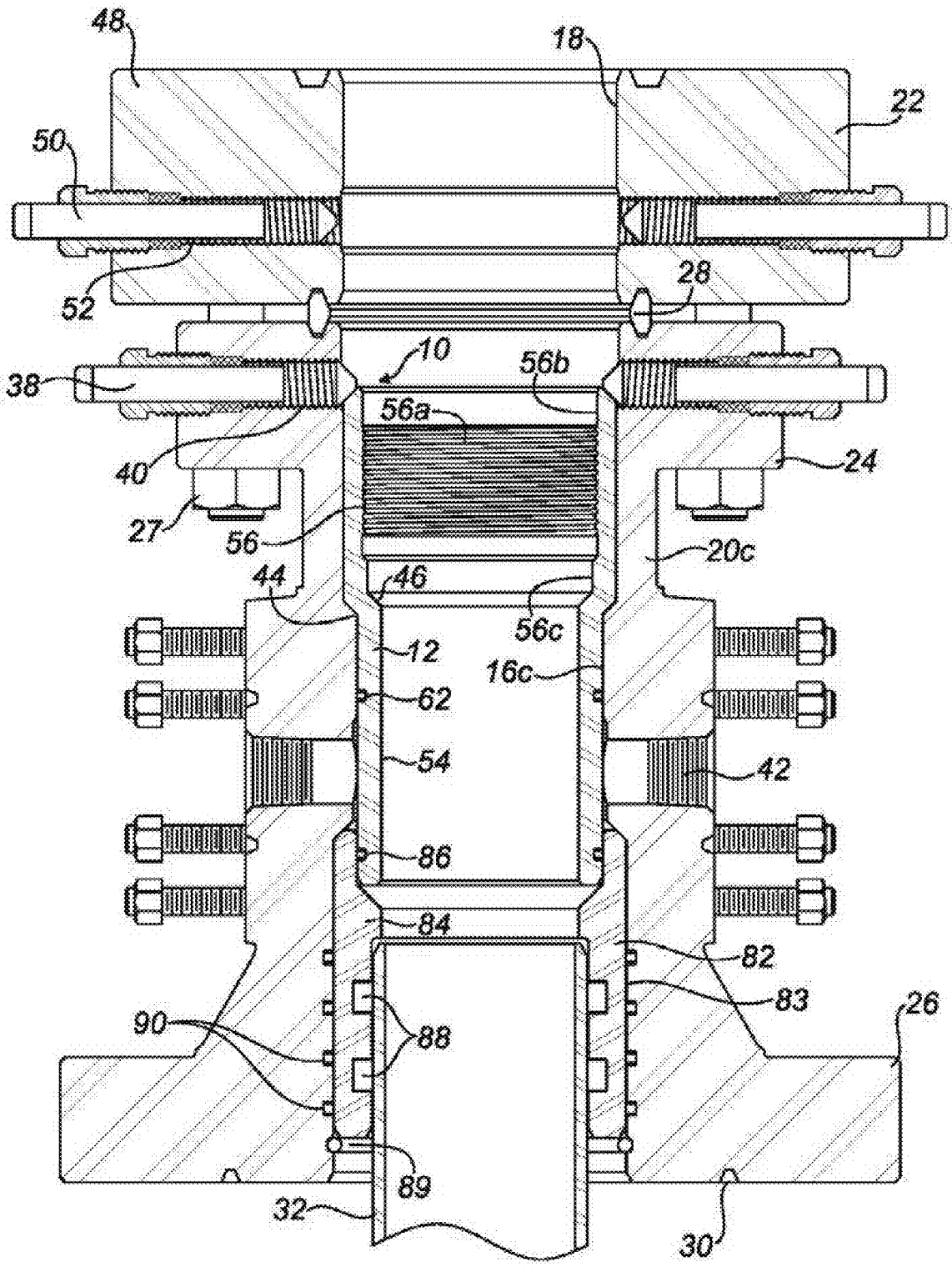
FIG. 10 is a side sectional view of a fourth embodiment of the method and apparatus of the present invention, which differs from the first embodiment in that it includes an interchangeable secondary seal bushing at the lower end of the tubing head for sealing to the production casing and the fracturing isolation tool.

FIG. 10 illustrates a fourth embodiment of the method and apparatus of the present invention, in which an interchangeable secondary seal bushing 82 is carried in a widened portion 83 of the vertical bore 16*c* at the lower end of the tubing head 20*c* for sealing to the production casing 32 and the fracturing isolation tool 12. The seal bushing 82 forms an inwardly extending bit guide 84 between its ends. Above the bit guide 84, the fracture isolation tool 12 carrier outer circumferential seal 86 to seal to the bore of the seal bushing 82. Below the bit guide 84, the seal bushing 82 carries outer secondary bushing casing seals 88 to the outer circumference of the production casing 32. The seal bushing 82 carries a plurality of outer circumferential seals 90 to the vertical bore 16*c* of the tubing head 20*c*. The seal bushing 82 is retained in the bore 16*c* at its lower end by bushing retainer 89. The interchangeable secondary seal bushing 82 allows for sealing to a wider range of casing environments. As can be seen from the Figures, this embodiment of the invention allows for full bore access to the production casing 32. The FIG. 10 uses same labels for similar features from previous embodiments.

FIGS. 11 and 12 illustrate a fifth embodiment of the method and apparatus of the present invention, in which the interchangeable secondary seal bushing 82 is used at the lower end of the tubing head 20*c*, as in FIG. 10. However, the embodiment differs from FIG. 10 in that the fracturing isolation tool 12*c* is elongated upwardly with an upper extension 13 to seal in the vertical bore 16*c* of the tubing head 20*c* above the tubing head lockscrews 38, instead of below the tubing head lockscrews 38. As mentioned above, in FIGS. 11 and 12, the fracturing isolation tool 12*c*, in order to seal to the vertical bore 16*c*, carries an additional circumferential seal 62*c* above the lockscrews 38. In this embodiment, the fracturing isolation tool 12*c* is formed with a groove or dimples 91 to receive the lockscrews 38 in order to retain the fracturing isolation tool 12 in the bore 16*c* of the tubing head 20*c*. The protector sleeve 14*c* is modified at its upper portion compared to the first embodiment to accommodate the upper extension 13 of the fracturing isolation tool 12*c*. The FIGS. 11 and 12 use same labels for similar features from previous embodiments.

Figure 13:
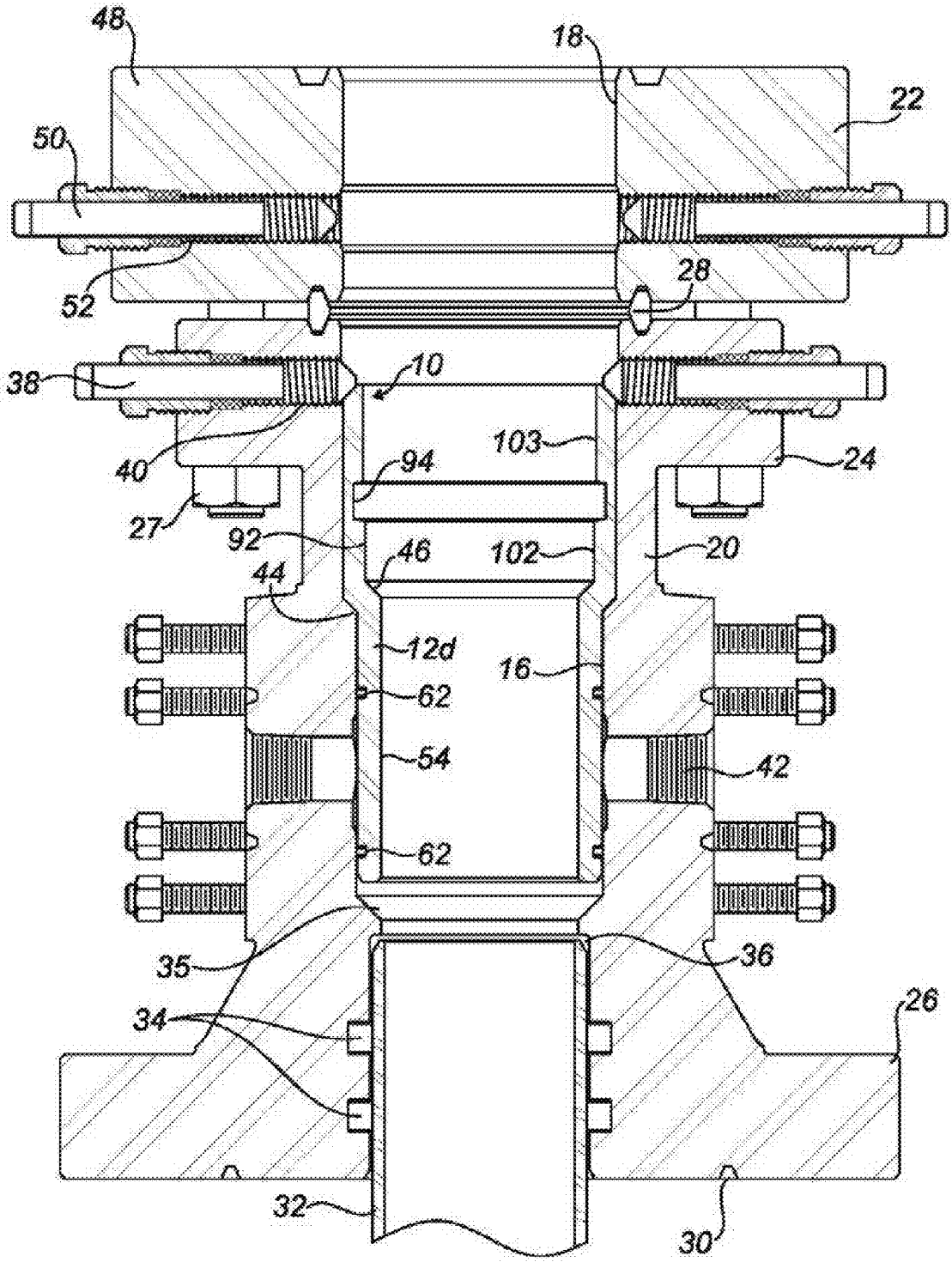
FIGS. 13-15 are side sectional views of a sixth embodiment of the method and apparatus of the present invention, differing from the first embodiment in that the profile for the pressure barrier in the fracturing isolation tool is formed with a circumferential groove to accept the outwardly protruding shoulders or dogs of the back pressure valve. In this embodiment, the lower end of the protector sleeve does not need the threads to protect, isolate and cover the pressure barrier profile, as in the first embodiment.
Figure 14:
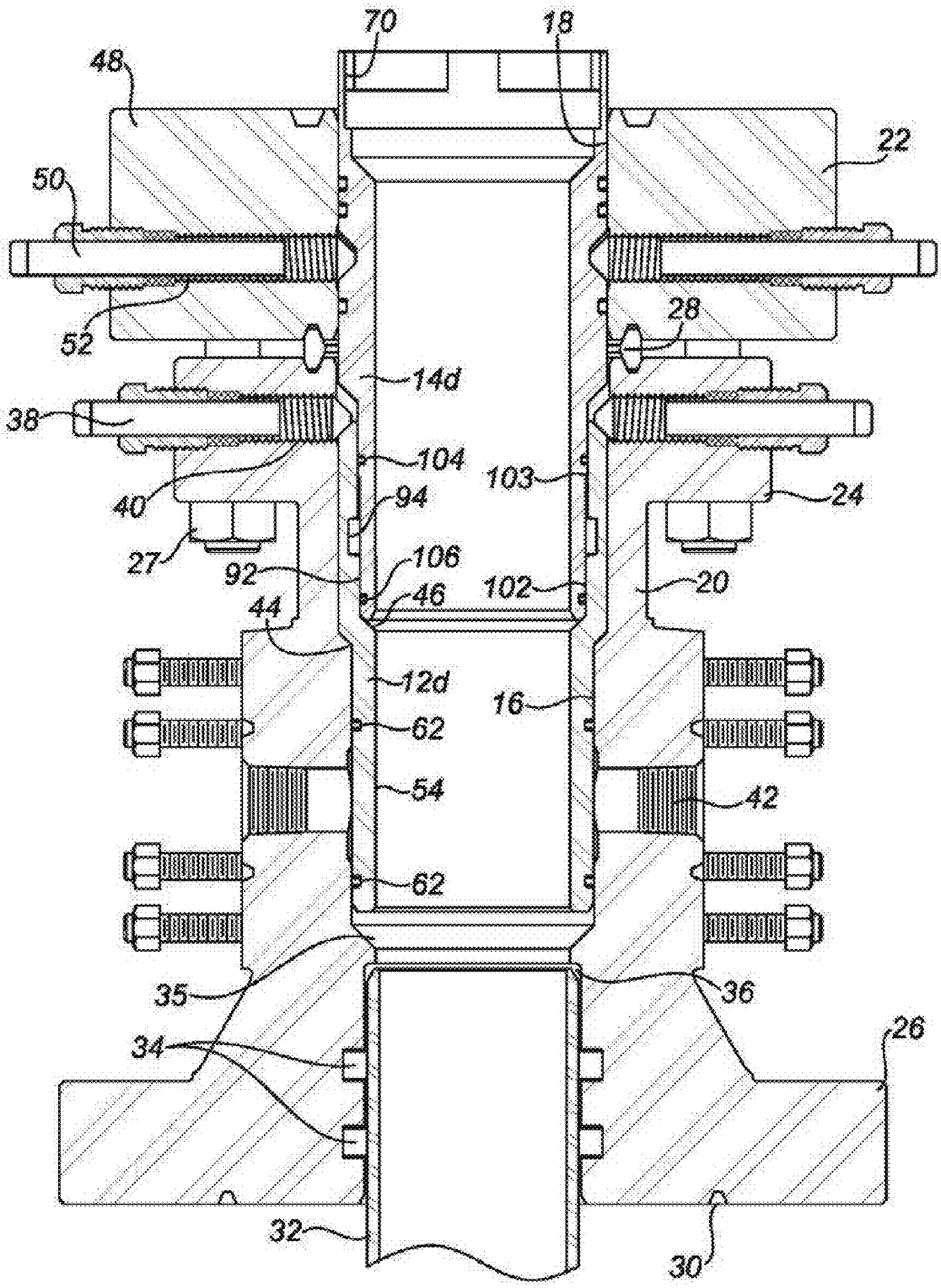
Figure 15:
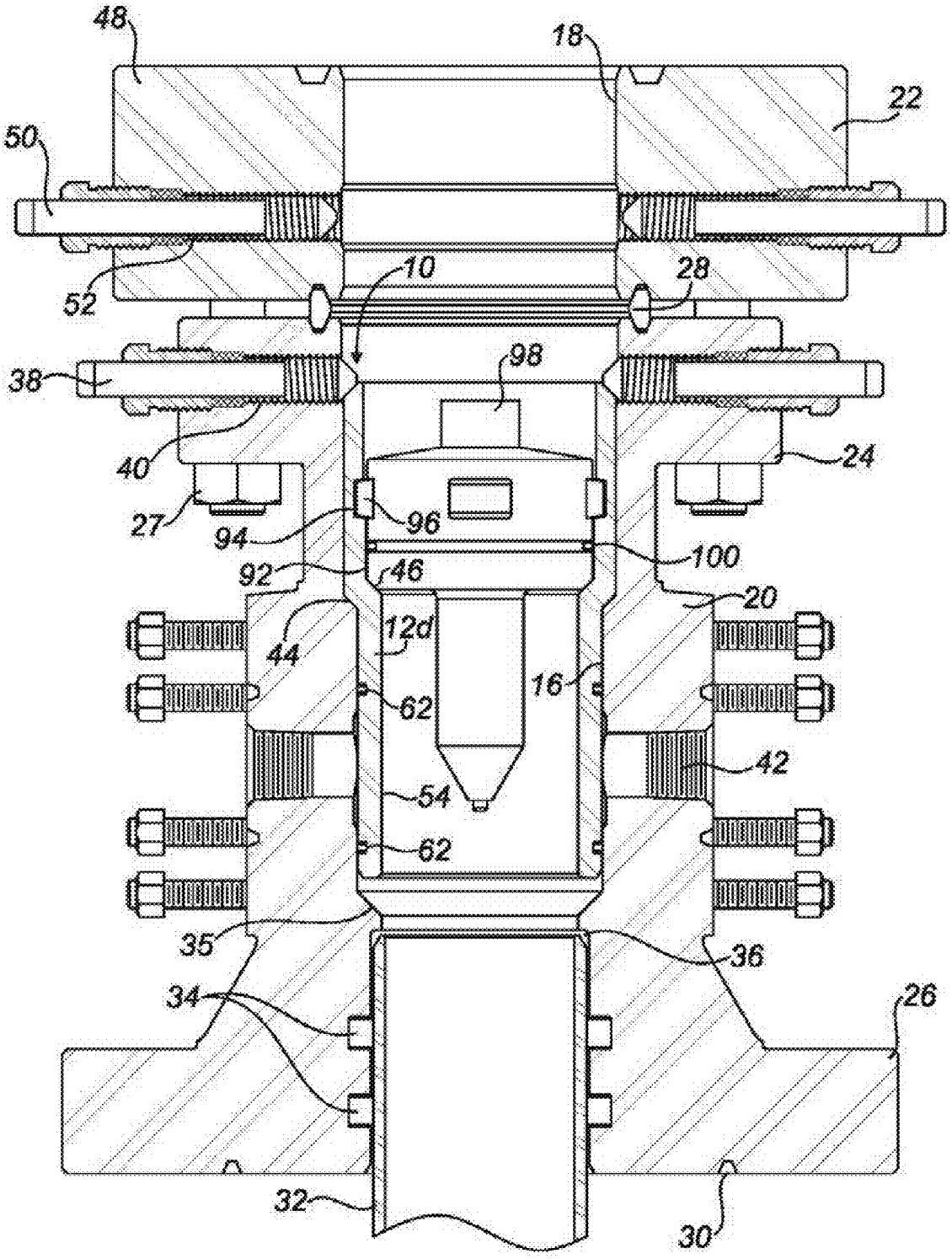

FIGS. 13-15 illustrate a sixth embodiment of the method and apparatus of the present invention which differs from the first embodiment in that the pressure barrier profile 92 in the fracturing isolation tool 12*d* is formed with a circumferential groove 94 to accept the outwardly protruding shoulders or dogs 96 of the back pressure valve 98. Back pressure valves of this type are well known and typically use springs (not shown) to outwardly bias the dogs 96 into the groove 94 on landing the valve 98 in the pressure barrier profile 92. Thus, like the interlocking threads of the previous embodiments, the dogs 96 and groove 94 provide an interlocking surface to retain a pressure barrier in the pressure barrier profile. The valve 98 carries a circumferential seal 100 to seal in lower sealing surface 102 of the pressure barrier profile 92. The protector sleeve 14*d* carries upper and lower circumferential seals 104, 106 located to seal above and below the groove 94, in upper sealing surface 103, and in lower sealing surface 102 in order to seal, isolate, cover and protect the pressure barrier profile 92 during fracturing. The FIGS. 13, 14 and 15 use same labels for similar features from previous embodiments.

Some of the illustrated embodiments of the present invention provide full bore access to the production casing 32 during fracturing (see first, fourth, fifth and sixth embodiments above). In that respect, the internal bore diameters of the fracturing isolation tool and the protector sleeve are equal to or greater than the drift diameter of the production casing 32.

The pressure barrier profile is shown in the Figures to be formed at the upper end of fracturing isolation tool, although it may be formed lower in the fracturing isolation tool. The pressure barrier profile will vary according to the particular pressure barrier that is to be run in after fracturing. Generally, the pressure barrier profile includes an interlocking surface to mate with portions of the pressure barrier. The profile is generally machined into the internal bore to include threads or circumferential grooves in order to retain the pressure barrier. One or more sealing surfaces are also included in the pressure barrier profile, above and/or below the interlocking surfaces, in order to seal the pressure barrier in due course. It is the interlocking surfaces of the pressure barrier profile, and preferably also the sealing surfaces, which are sealed, protected, isolated and covered by the protector sleeve during fracturing. The protector sleeve preferably carries one or more circumferential seals to seal above and/or below the interlocking surfaces. These circumferential seals may seal on the sealing surfaces of the profile, or above and/or below the sealing surfaces, as needed to protect the pressure barrier profile against the fracturing pressures and fracturing fluids. The embodiments shown in the figures show threaded pressure barrier profiles with sealing surfaces formed above and below the threads (FIGS. 1-12), and a grooved pressure barrier profile, with a sealing surface below the grooves (FIGS. 13-15). In both embodiments, the protector sleeve preferably carries circumferential seals to seal above and below the interlocking surface, and above and below the sealing surface(s). Alternate pressure barrier profiles, as noted above, are possible within the scope of the claims of the present invention, depending on the particular wellhead body members and pressure barriers to be used.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention. One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practiced in the absence of any element or elements, limitation or limitations which is not specifically disclosed herein.

We claim:

1. A wellhead assembly which seals to a production casing, comprising:

one or more pressure-containing wellhead body members defining a vertical bore extending there through, the lowermost end of the one or more wellhead body members being adapted to seal to the production casing;

a fracturing isolation tool sealed in the vertical bore of the one or more wellhead body members above the production casing, and forming an internal bore extending vertically there through, a pressure barrier profile formed in the internal bore of the fracturing isolation tool to accommodate a pressure barrier; and a removable protector sleeve located at least partially within the fracturing isolation tool to seal, protect, isolate and cover the pressure barrier profile against a fracturing pressure and a fracturing fluid, the protector sleeve forming an internal bore extending vertically there through.

2. The wellhead assembly of claim 1, wherein:

the one or more wellhead members comprise a tubing head and a tubing head adapter connected above the tubing head;

the fracturing isolation tool seals in the vertical bore of the tubing head, and the protector sleeve seals in the vertical bore of the tubing head adapter; and the pressure barrier profile is formed in the fracturing isolation tool at a location to be within the tubing head when the fracturing isolation tool is sealed in the tubing head, such that when the fracturing isolation tool and the protector sleeve are sealed in the vertical bores, all seals and openings in and between the tubing head and the tubing head adapter are protected from the fracturing pressure and the fracturing fluid.

3. The wellhead assembly of claim 2, wherein the fracturing isolation tool and the protector sleeve are removable through the tubing head and tubing head adapter.

4. The wellhead assembly of claim 2, wherein the pressure barrier profile is formed with an interlocking surface to retain the pressure barrier and a sealing surface for the pressure barrier, and wherein the protector sleeve carries one or more circumferential seals to seal the pressure barrier profile in order to protect, isolate and cover the interlocking surface and the sealing surface of the pressure barrier profile.

5. The wellhead assembly of claim 4, wherein the protector sleeve carries two or more circumferential seals in order to seal above and below the interlocking surface and to seal either on, or above and below, the sealing surface of the pressure barrier profile.

6. The wellhead assembly of claim 5, wherein:

the interlocking surface of the pressure barrier profile is a threaded surface to mate with threads on the pressure barrier;

the sealing surface of the pressure barrier profile is located above and below the threaded surface; and the protector sleeve carries the two or more circumferential seals to seal on the sealing surface above and below the threaded surface.

7. The wellhead assembly of claim 5, wherein:

the interlocking surface of the pressure barrier profile is formed with one or more circumferential grooves to mate with one or more shoulders or dogs carried on the pressure barrier;

the sealing surface of the pressure barrier profile is located above or below the one or more circumferential grooves; and the protector sleeve carries the two or more circumferential seals to seal above and below the one or more circumferential grooves and to the sealing surface.

8. The wellhead assembly of claim 5, wherein the internal bore of the fracturing isolation tool has a diameter equal to or greater than the diameter of the production casing.

9. The wellhead assembly of claim 8, wherein the internal bore of the protector sleeve has a diameter equal to or greater than the diameter of the production casing.

10. The wellhead assembly of claim 5, wherein the fracturing isolation tool carries seals at its lower end to seal inside the production casing.

11. The wellhead assembly of claim 5, wherein the protector sleeve extends through the fracturing isolation tool and carries seals at its lower end to seal inside the production casing.

12. The wellhead assembly of claim 5, further comprising a seal bushing sealed within the vertical bore of the tubing head to seal to the lower end of the fracturing isolation tool and to the production casing.

13. The wellhead assembly of claim 5, further comprising a pressure barrier profile formed in the bore of the protector sleeve.

14. The wellhead assembly of claim 4, wherein the fracturing isolation tool and the protector sleeve are removable through the tubing head, the tubing head adapter and at least one wellhead member located thereabove.

15. The wellhead assembly of claim 1, further comprising a pressure barrier for sealing in the pressure barrier profile of the fracturing isolation tool when the protector sleeve is removed.

16. A fracturing isolation assembly for use in one or more pressure-containing wellhead body members which define a vertical bore extending there through, the lowermost end of the one or more wellhead body members being adapted to seal to a production casing, the fracturing isolation assembly comprising:

a fracturing isolation tool adapted to seal in the vertical bore of the one or more wellhead body members above the production casing, and forming an internal bore extending vertically there through, a pressure barrier profile formed in the internal bore of the fracturing isolation tool to accommodate a pressure barrier;

a removable protector sleeve located at least partially within the fracturing isolation tool to seal, protect, isolate and cover the pressure barrier profile against a fracturing pressure and a fracturing fluid, the protector sleeve forming an internal bore extending vertically there through.

17. The fracturing isolation assembly of claim 16, wherein:

the one or more wellhead members comprise a tubing head and a tubing head adapter connected above the tubing head;

the fracturing isolation tool seals in the vertical bore of the tubing head, and the protector sleeve seals in the vertical bore of the tubing head adapter; and the pressure barrier profile is formed in the fracturing isolation tool at a location to be within the tubing head when the fracturing isolation tool is sealed in the tubing head, such that when the fracturing isolation tool and the protector sleeve are sealed in the vertical bores, all seals and openings in and between the tubing head and the tubing head adapter are protected from the fracturing pressure and the fracturing fluid.

18. The fracturing isolation assembly of claim 17, further comprising a pressure barrier for sealing in the pressure barrier profile of the fracturing isolation tool when the protector sleeve is removed.

19. A method of isolating one or more wellhead members for fracturing, comprising:

providing one or more pressure-containing wellhead body members defining a vertical bore extending there through to communicate with the production casing, the lowermost end of the one or more wellhead body members being adapted to seal to the production casing;

locating a fracturing isolation tool in sealing relationship in the vertical bore of the one or more wellhead body members above the production casing, the fracturing isolation tool forming an internal bore extending vertically there through, and having a pressure barrier profile formed in the internal bore to accommodate a pressure barrier;

locating a removable protector sleeve at least partially within the fracturing isolation tool to seal, protect, isolate and cover the pressure barrier profile against a fracturing pressure and a fracturing fluid, the protector sleeve forming an internal bore extending vertically there through;

such that, when the fracturing isolation tool and the protector sleeve are sealed in the vertical bore, all seals and openings in the one or more wellhead body members are protected from a fracturing pressure and a fracturing fluid.

20. The method of claim 19, which further comprises:

after fracturing, removing the protector sleeve; and locating a pressure barrier in sealing relationship in the pressure barrier profile of the fracturing isolation tool.

21. The method of claim 20, wherein:

the one or more wellhead members are provided as a tubing head and a tubing head adapter mounted above the tubing head;

the fracturing isolation tool is located to seal in the vertical bore of the tubing head, and the protector sleeve is located to seal in the vertical bore of the tubing head adapter; and the pressure barrier profile is formed in the fracturing isolation tool at a location within the tubing head;

such that when the fracturing isolation tool and the protector sleeve are sealed in the vertical bore, all seals and openings in the tubing head and the tubing head adapter are protected from the fracturing pressure and the fracturing fluid.

* * * * *